US006830659B2

(12) United States Patent
Sovijärvi

(10) Patent No.: US 6,830,659 B2
(45) Date of Patent: Dec. 14, 2004

(54) APPARATUS FOR MEASURING THE WEAR OF A DOCTOR BLADE AND METHOD IN MEASURING THE WEAR OF A DOCTOR BLADE AND IN CONTROLLING A PAPER MACHINE

(75) Inventor: Tero Sovijärvi, Haavisto (FI)

(73) Assignee: Metso Paper, Inc., Helsinki (FI)

( * ) Notice: Subject to any disclaimer, the term of this patent is extended or adjusted under 35 U.S.C. 154(b) by 58 days.

(21) Appl. No.: 10/288,666

(22) Filed: Nov. 5, 2002

(65) Prior Publication Data

US 2003/0089208 A1 May 15, 2003

(30) Foreign Application Priority Data

Nov. 12, 2001 (FI) ..... 20015038

(51) Int. Cl.[7] ..... D21F 7/06

(52) U.S. Cl. ..... 162/263; 162/281; 162/198; 73/105; 33/504; 33/505; 33/506; 427/211; 427/355; 427/359

(58) Field of Search ..... 162/263, 281, 162/198; 73/105; 33/504, 505, 506; 15/256.51; 118/118, 126, 413; 427/211, 355–356, 359

(56) References Cited

U.S. PATENT DOCUMENTS 3,884,145 A * 5/1975 Datwyler ..... 101/169
4,358,974 A 11/1982 Sakurai
4,691,406 A * 9/1987 Goodnow et al. ..... 15/256.53
5,296,257 A * 3/1994 Knop et al. ..... 427/10
5,403,446 A * 4/1995 Trelsmo et al. ..... 162/281
5,612,091 A * 3/1997 Paloviita et al. ..... 427/355
5,654,799 A * 8/1997 Chase et al. ..... 356/600
5,944,958 A * 8/1999 Svanqvist ..... 162/281
5,970,427 A * 10/1999 Greenwald ..... 702/33

FOREIGN PATENT DOCUMENTS

FI 103596 5/1998
FI 4289 9/1999

* cited by examiner

*Primary Examiner*—Peter Chin
*Assistant Examiner*—Mark Halpern
(74) *Attorney, Agent, or Firm*—Fildes & Outland, P.C.

(57) ABSTRACT

An apparatus for measuring wear of a doctor blade includes measuring members placed around the doctor blade for measuring at least one dimension of the doctor blade. The measuring members are arranged to permit longitudinal movement of the doctor blade between the doctor blade and the measuring members. In addition, measurement sensors are connected to the measuring members to obtain a continuous measurement result when the doctor blade or the apparatus is moved. The invention also relates to a method in the measurement of wear of a doctor blade and in controlling a paper machine.

8 Claims, 4 Drawing Sheets

APPARATUS FOR MEASURING THE WEAR OF A DOCTOR BLADE AND METHOD IN MEASURING THE WEAR OF A DOCTOR BLADE AND IN CONTROLLING A PAPER MACHINE

FIELD OF THE INVENTION

The present invention relates to an apparatus for measuring the wear of a doctor blade, which apparatus includes measuring members placed around a used doctor blade for measuring at least one dimension of the doctor blade. The invention also relates to a method in measuring the wear of a doctor blade and in controlling a paper machine.

BACKGROUND OF THE INVENTION

Doctor blades are generally designed in such a way that they wear in use. This allows the doctor blades to remain sharp and gives the best possible doctoring result. However, the rate of wear of doctor blades varies in individual cases. The rate of wear is influenced by, for example, the blade materials used, the surface being doctored, and the material being scraped off the surface. Particularly in paper machines, long doctor blades are used, in which the wear often varies in the cross-machine direction, i.e. in the longitudinal direction of the doctor blade. The wear also varies from blade to blade between different doctor blades. Usually, experience can be used to provide a sufficiently adequate estimate of the wear. Wear can also be monitored, for example, by measuring the change in angle of the doctor-blade holder. However, the blade holder is often so stiff that a change in the angle of the blade due to local wear in the doctor blade does not show as deformation of the blade holder. This means that it is impossible to determine the wear of the doctor blade from the deformation of the blade holder, at least in connection with so-called rigid blade holders. In other ways too, measuring the change of angle to determine the wear in the doctor blade is an imprecise method, even though online information is then advantageously obtained.

In practice, the actual wear can be measured from a doctor blade, only after it has been removed from its operating location (offline information). It is then possible to determine the wear either by eye, or, for example, by using a vernier gauge to measure different points on the doctor blade. Both ways are imprecise and the measurement in particular is labourious. Measuring doctor blades that can be more than ten-metres long is slow and it is difficult to record the measurement results obtained. In addition, special blade-changing apparatuses, employing bands containing several doctor blades, are nowadays used to accelerate doctor-blade changes. The band is stored on a reel and is moved mechanically. However, it is impossible to measure a doctor blade on a reel. In addition, a single band can last in use for several weeks. It is then impossible to correct sudden disturbances in wear, even though the doctor blade would be measured after being removed from the reel.

SUMMARY OF THE INVENTION

The invention is intended to create a new type of apparatus for measuring wear of a doctor blade, by means of which wear can be measured rapidly and accurately. The invention is also intended to create a new type of method for measuring wear of a doctor blade, by means of which the actual wear and its shape can be determined. Further, the invention is intended to create a new type of method for controlling a paper machine, by means of which the control is more rapid and precise than previously.

Accordingly, an apparatus according to the present invention for measuring wear of a doctor blade, which apparatus includes measuring members placed around the used doctor blade for measuring at least one dimension of the doctor blade, is characterized in that the measuring members are arranged to permit longitudinal movement of the doctor blade between the doctor blade and the measuring members and that to the measuring members are connected measurement sensors for obtaining a continuous measurement result when the doctor blade or the apparatus is moved.

Correspondingly, a method according to the invention for measuring wear of a doctor blade, in which method at least one dimension is measured at different points on a worn doctor blade, is characterized in that the dimension is measured essentially continuously while the doctor blade moves and at the same time the longitudinal movement of the doctor blade is measured, so that the longitudinal wear profile of the doctor blade is determined from the results obtained.

Another method according to the invention for controlling a paper machine, in which method the paper machine is controlled on the basis of data collected from it, is characterized in that the data is collected on at least one doctor blade forming part of the paper machine, which data is compared to previous data on doctor blades used in the same position and, at the same time, to data generally collected from the paper machine, so that if the collected data differ from the previous data the paper machine is controlled.

The apparatus according to the invention is applied in connection with a doctor blade and it is used to measure wear over the entire length of the doctor blade. The measurement can preferably be made continuously, so that the wear can be determined rapidly and accurately. The apparatus can be located in different positions, either permanent or movable. In addition, the apparatus is suitable for use in connection with different kinds of doctor blades. With the aid of the method according to the invention, the actual shape and extent of the wear can be determined. In addition, it is possible to influence the causes of the wear more rapidly than before.

These and other features and advantages of the invention will be more fully understood from the following detailed description of the invention taken together with the accompanying drawings.

DETAILED DESCRIPTION OF THE INVENTION

Figure 1:
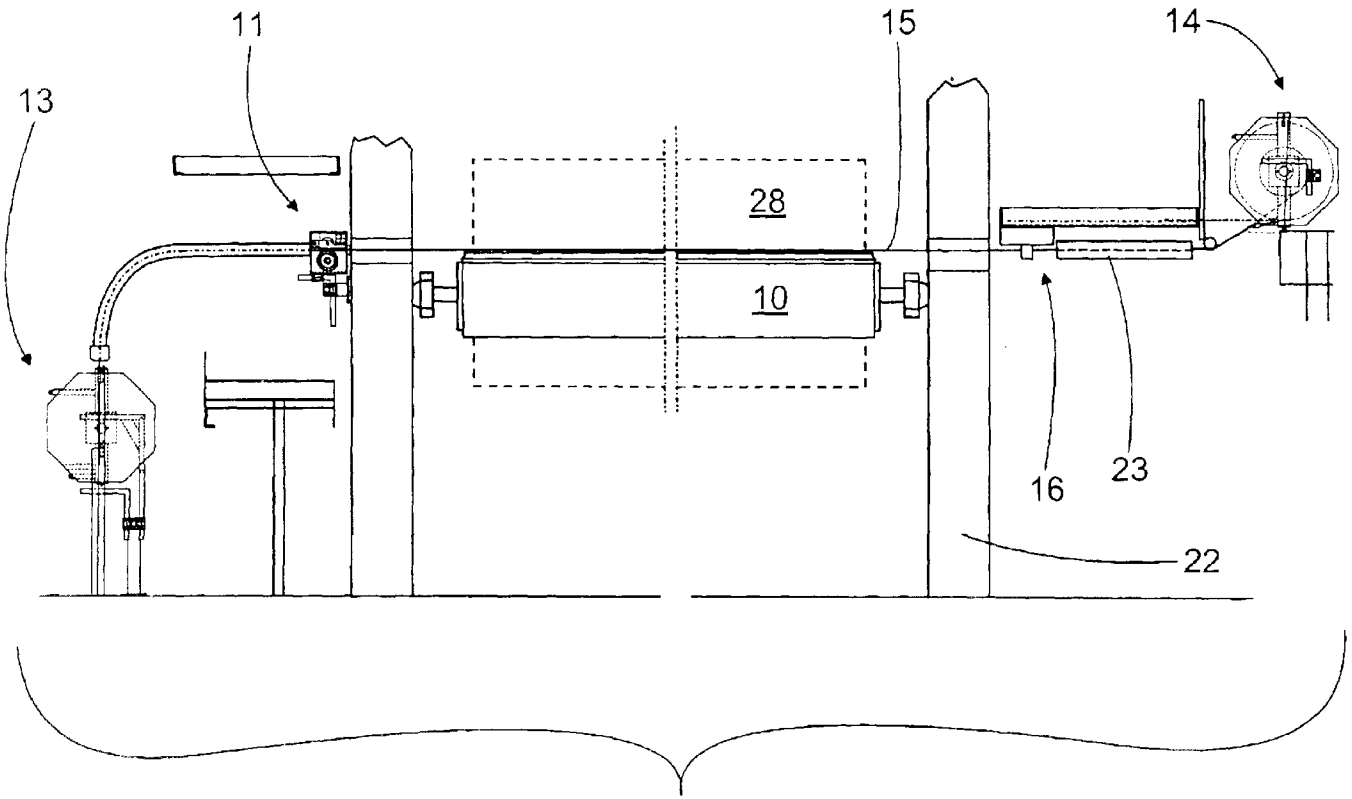
FIG. 1 shows a view in the machine direction of the apparatus according to the invention located in connection with a blade-changing apparatus.

FIG. 1 shows a blade-changing apparatus 11 arranged in connection with a doctor apparatus 10, seen from the machine direction. Such blade-changing apparatuses are used particularly in wide paper and board machines. In this case, the doctor blade is taken to the reel 13 as a rolled-up band 15 and is lead through the doctor apparatus 10 to the other side of the paper machine. Generally, there are several consecutive doctor blades in a single band, making it possible to change the doctor blade mechanically. In this case, the apparatus 16 according to the invention is located in connection with the blade-changing apparatus 11, which will be examined in greater detail later.

Figure 2:
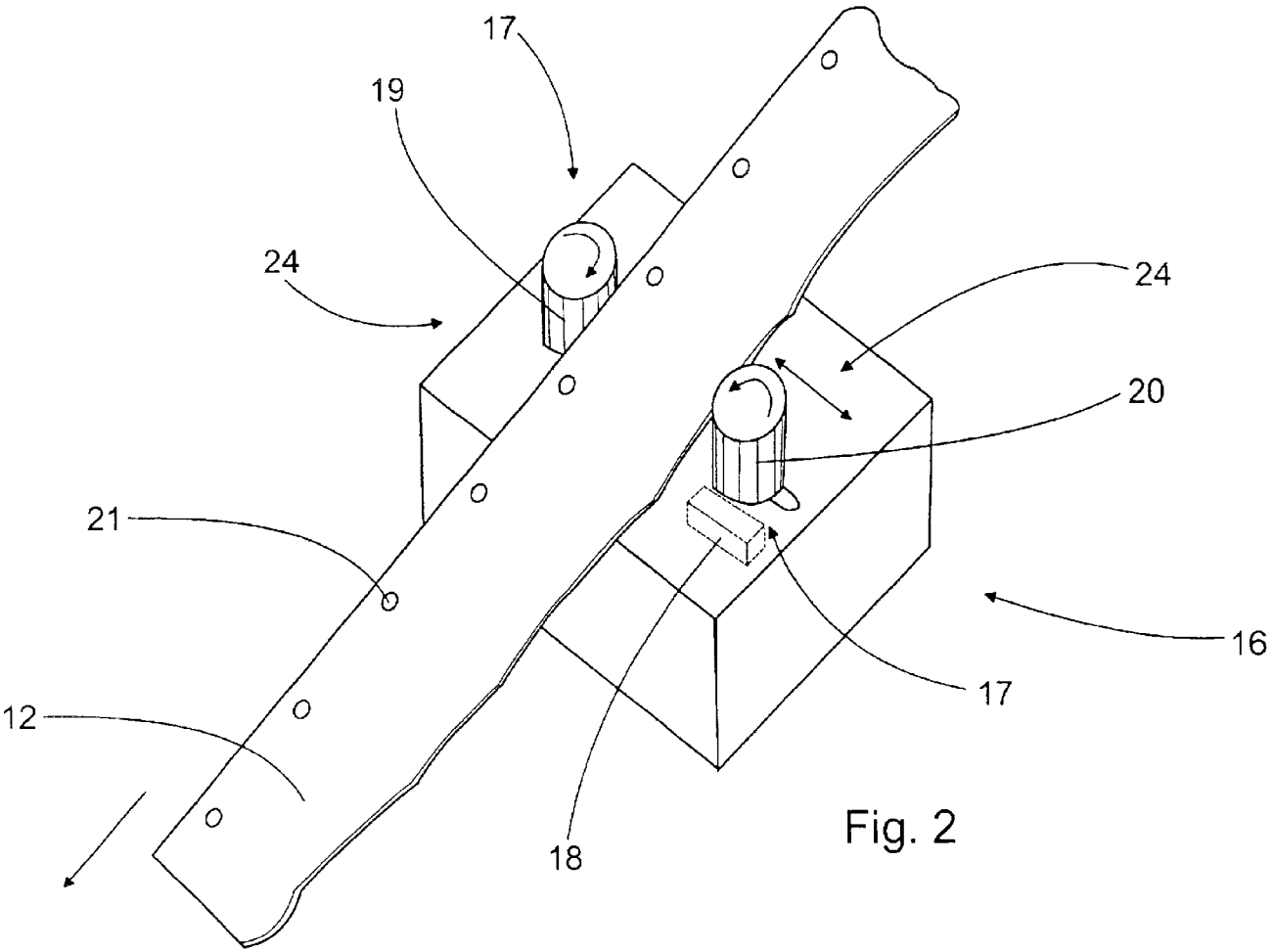
FIG. 2 shows a schematic drawing of the apparatus according to the invention in connection with a doctor blade.

The apparatus according to the invention is particularly intended to measure the wear in the doctor blade. Generally, the apparatus 16 includes measuring members 17 placed around the used doctor blade 12, in order to measure at least one dimension of the doctor blade 12 (FIG. 2). The measuring members according to the invention are arranged to permit longitudinal movement between the doctor blade and the measuring members. In other words, the doctor blade or the measuring members can be moved during the measurement. In addition, measurement sensors 18 are connected to the measuring members 17, in order to obtain a continuous measurement result when the doctor blade 12 or the apparatus 16 is being moved. Thus, the wear can be measured rapidly, for example, when the doctor blade is being changed. This is an important advantage, particularly with the aforesaid blade-changing apparatus, in which it is otherwise impossible to measure the doctor blade.

According to the invention, at least one of the measuring members of the apparatus is arranged to measure not only the said dimension, but also the movement between the doctor blade and the measuring member. This makes it possible to determine simply the longitudinal wear profile of the doctor blade. The utilization of the wear profile will be examined in greater detail later. FIG. 2 shows the apparatus 16 according to the invention in greater detail. In this case, each measuring members 17 is rotatably supported on a roller 19 and 20, which is arranged to be set against the doctor blade 12. The roller 19 arranged to receive the rear of the doctor blade 12 is preferably fixed, which simplifies the construction of the apparatus 16. Correspondingly, the roller 20 in contact with the worn side of the doctor blade 12 is arranged to move in the transverse direction of the doctor blade 12. Thus, by measuring the movement of the relevant roller 20, the wear of the doctor blade 12 is determined. Correspondingly, by measuring the rotation of one or other or both of the rollers 19 and 20, it is possible to determine the location of the wear in the longitudinal direction of the doctor blade 12. In other words, the wear profile of the doctor blade can be determined directly from two measurement results.

Figure 4:
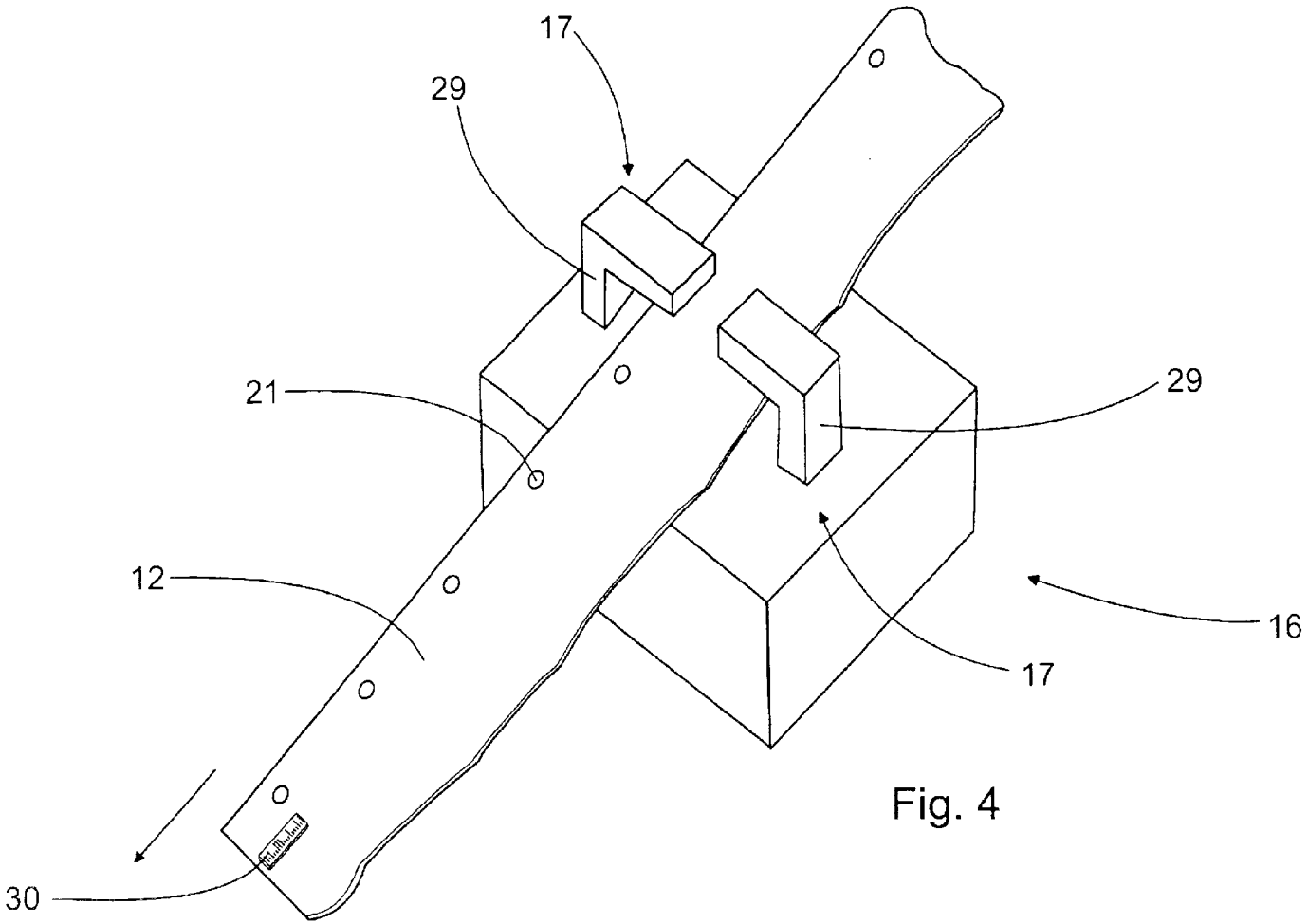
FIG. 4 shows a schematic drawing of a second embodiment of the apparatus according to the invention in connection with a doctor blade.

Generally, there are 2–4, preferably 2–3 rollers in the apparatus. Particularly the measuring member arranged to receive the rear of the doctor blade can have some other shape, for example, as such a conventional slide guide. In addition, the surface of the rollers is suitably treated to create sufficient friction. The treatment avoids slipping between the roller and the doctor blade, which would result in an error in the wear profile. The rollers can also have a suitable surfacing. In place of mechanical measuring members, it is possible to use, for example, optical measuring members. For example, wear can be measured without contact by means of pattern recognition or laser measurement. The support of the measuring members and the connections of the measurement sensors fitted to them are, as such, known technology, so that they are not described. In practice, when the measuring members 17 respond to the front and rear of the doctor blade 12, it is possible, for example, to use the rivets 21 shown in FIG. 2. FIG. 4 shows a contactless detector member 29 for measuring the doctor blade 12.

In the blade-changing apparatus 11 shown in FIG. 1, it is advantageous to use the apparatus 16 according to the invention. In the blade-changing apparatus 11, a band 15 containing one or several doctor blades is positioned on two reels 13 and 14 on each side of the surface 28 being doctored. According to the invention, the apparatus 16 is fitted permanently in connected with the doctor blade, on the side of the blade-changing apparatus 11 with the reel 14 containing the used doctor blade. Thus, the blade-changing apparatus is used to create the movement of the doctor blade, so that the construction of the apparatus can be simple and small. This facilitates the positioning of the apparatus. The apparatus 16 is preferably located between the frame forming part of the paper machine and the blade guide 23 forming part of the blade-changing apparatus 11, according to FIG. 1. The doctor blade will then be suitably positioned, while the movement of the doctor blade will be as small as possible. In FIG. 1, the apparatus 16 is positioned in such a way that the measuring members are beneath the apparatus 16. In that case, there is as little dirtying of the measuring members as possible. Dirtying can also be avoided with the aid of suitable casing (not shown).

Differing from the above description, the apparatus can also be used in connection with a single doctor blade that has been removed from its operating position. In that case, the apparatus is preferably arranged to be movable. The apparatus also includes transfer members for moving the doctor blade while the apparatus remains stationary. Thus, for example, a used doctor blade that has been placed on the floor can be measured for wear rapidly and accurately using the movable apparatus according to the invention. In addition, at least one measuring members is arranged as a transfer member. The construction of the apparatus will then remain as simple as possible. It is also possible to use various transfer members in connection with the apparatus. In the embodiment of FIG. 2, both rollers 19 and 20 are preferably drive rollers. In other words, the measuring members 17 also act as transfer members 24. The wear can also be measured without transfer members, by pulling the doctor blade manually through the apparatus. In addition, if the apparatus is made sufficiently light and small, it can be moved while the doctor blade remains in place. In such an apparatus, contactless measuring members in particular are especially advantageous. For example, in the manufacturing stage, marks can be attached to the doctor blade at regular intervals, which can be detected contactlessly by the measuring members. Longitudinal measuring data can then be obtained from the doctor blade. Correspondingly, the wear in the doctor blade can be determined, for example, using pattern recognition or laser measurement. Contactless measuring members can also be utilized in connection with blade-changing apparatuses, in which there are already devices for moving the doctor blade.

In the method according to the invention, at least one dimension of a worn doctor blade is measured at different points. According to the invention, the said dimension is measured essentially continuously while the doctor blade moves. At the same time, the longitudinal movement of the doctor blade is measured. From the results then obtained, the longitudinal wear profile of the doctor blade is determined. Monitoring of the wear profiles will provide valuable information on doctor blades and their behaviour in different situations. Measurement can be used to investigate such things as the rate of wear, the wear profile, and the average life of the blade. This information can be exploited, for example, when planning service intervals. The information can be exploited in product development.

Figure 3:
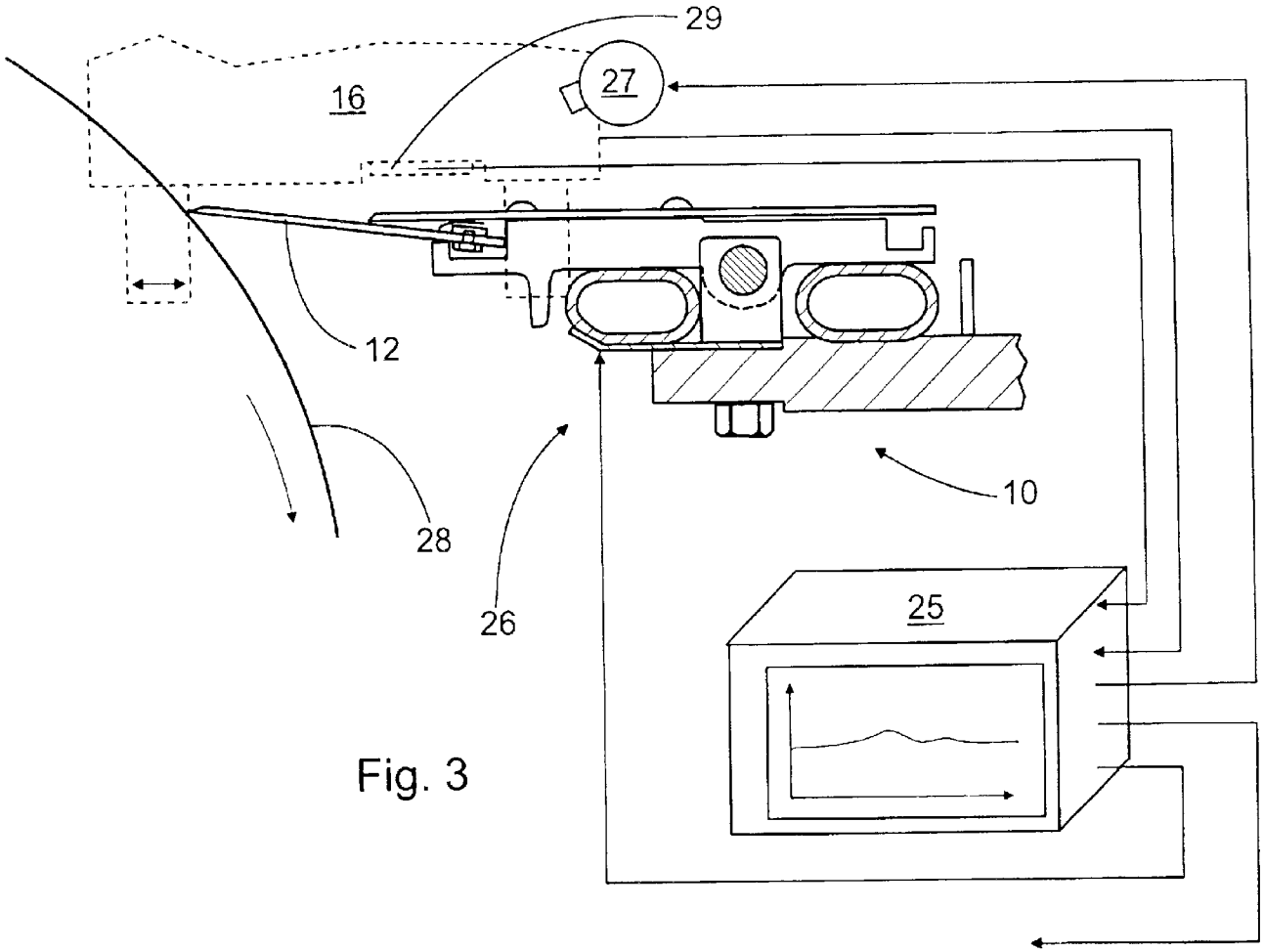
FIG. 3 shows a schematic drawing of the arrangement used in the method according to the invention.

The method can be exploited particularly in connection with the blade-changing apparatus of a paper machine. It is possible to measure wear in a band containing one or several doctor blades, used in a blade-changing apparatus, immediately the band is moved. In addition, the measurement results of doctor blades used in the same position can be compared with previous measurement results. Thus, if the measurement results deviate from earlier measurement results and/or from the designed wear, the paper machine can be controlled to bring the wear of the doctor blades to the designed level. Generally, a sudden change in the rate of wear or the wear profile is a sign of some problem or deviation in the doctor apparatus, or in the paper machine in general. Thanks to the rapid provision of information, it is possible to react to changes considerably faster than usual. FIG. 3 shows a schematic drawing of a doctor apparatus 10, to which an apparatus 16 according to the invention is connected. The measurement results advantageously obtained using the apparatus are attached to the control system 25 forming part of the paper machine, in order to control the paper machine. Thus separate data collection and recording devices are unnecessary. The control system 25 can be used to create a wear profile of the doctor blade, from which possible deviations can be defined. The deviations are obtained by comparing the wear profile hat has been just measured with previously realized wear profiles. At the same time, it is also possible to compare, for example, the rate of wear. When a deviation appears, it is possible, if desired, to make corrections by controlling the paper machine either manually or automatically. For example, the rate of wear of the doctor blade can be influenced by altering the loading in the blade holder 26 and/or by adjusting the lubrication jets 27. Should the process settings have also changed, an indication of this can be obtained by means of the method according to the invention. If the doctor blade has worn locally, there may be changes in the surface 28 being doctored. Generally, when there is a change in the wear of the doctor blade, the causes can be sought more quickly than previously by using the method and apparatus according to the invention. In addition to adjustment, the information obtained can give a clear indication of a need to change the blade material and/or type of the doctor blade. The wear data collected using the method and apparatus can also be exploited inversely, so that a conscious change is made to some process setting, or a different blade material is used in the doctor blade. In that case, the effects of the change on the wear of the doctor blade will quickly become apparent.

According to the invention, other information about the doctor blade, besides the wear profile, can also be collected. For this purpose, at least one identifier 30 (FIG. 4) is attached to the doctor blade 12. The identifier contains information, such as the blade material, the manufacturing batch, dimensions, and, if necessary, the position. The information included in the identifier can be preferably read using a contactless detector member 29 belonging to the apparatus 16 according to the invention. This makes a separate identifier reader device unnecessary. The identifier is preferably read automatically, though portable devices can be manual. The detector members can also be used to enter or update information in more developed identifiers, such as, for example, data carriers. For example, the dates of installation and removal, and the measured wear profile will then be automatically recorded in the identifier. FIG. 4 shows a data carrier as the identifier 30, above which there is also a bar code. If the doctor blade is shredded, the identifier can be preserved and sent elsewhere for processing. A small length of the doctor blade, containing the identifier, can also be cut off, thus also providing a blade sample.

The identifier is preferably read both during installation and on removal. If the detector member is connected to the paper machine's control system, the information can be transferred to the control system, without being recorded in the identifier. It is then possible to use a simple identifier, such as the aforementioned bar code. The detector member for reading the identifier and determining the wear profile can also be centralized, making position-specific detector member unnecessary. In practice, the detector member can be located, for example, in the shredder. It is also possible to add laser angle measurement in connection with the detector member, which is necessary especially in connection with coater blades.

With the aid of the identifier, doctor blades can be individualized. In addition, by collecting information from the paper machine during operation and comparing it with the longitudinal wear profile of the doctor blade, it is possible to control the paper machine more quickly and accurately than before. The data collected includes among others the running speed, the paper grade and the stock composition. Generally, the blade pressure, the doctor jets, and the wet-end chemistry are also monitored. Further, the general operating data of a possible steam box, the surface being doctored, and the blade are recorded.

By combining the aforementioned data with blade-specific data it is possible to determine the correspondence between the process and the wear of the blade. Thus, it is possible, for example, to predict the rate of wear of the doctor blade for each position and to compare different blade materials. The results can thus also be utilized in the use of doctor blades and in product development. It is also possible to use the method to detect quality deviations in the doctor blades and correspondences between the rate of wear and raw-material batches and manufacturing batches.

The apparatus according to the invention is economical and has a simple construction and is above all rapid and precise. In addition, the apparatus can be applied to different kinds of doctor blades. The rate of wear and particularly the wear profile obtained with the apparatus makes it possible to notice changes in the process. Correspondingly, the effect on wear of changes in a single setting can be charted. For example, it is possible to test the effect of loading on wear in the doctor blade. However, what is essential is the continuous measurement of wear and the wear profile that can be created from it.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. An apparatus for measuring wear of a used doctor blade, which apparatus includes measuring members placed around the used doctor blade for measuring at least one dimension of the doctor blade, characterized in that the measuring members are arranged to permit longitudinal movement of the doctor blade between the doctor blade and the measuring members and that to the measuring members are connected measurement sensors for obtaining a continuous measurement result when the doctor blade or the apparatus is moved, and at least one measuring member is arranged to measure, not only the said dimension, but also the movement between the doctor blade and the measuring member in order to determine the longitudinal wear profile of the doctor blade.

2. The apparatus according to claim 1, characterized in that each measuring member is rotatably supported on a roller, which is arranged to be placed against the doctor blade.

3. The apparatus according to claim 2, characterized in that there are 2–4, rollers and at least the rollers on the worn side of the doctor blade are arranged to be movable in the transverse direction of the doctor blade.

4. The apparatus according to claim 1 in a paper machine, which includes a surface being doctored and a blade-changing apparatus, in which a band, located on two reels on each side of the surface being doctored and containing one or several doctor blades is used, characterized in that the apparatus is fitted permanently in connection with the doctor blade, on the side of the blade-changing apparatus with one of the reels containing the used doctor blade.

5. The apparatus according to claim 4, characterized in that the apparatus is located between the frame forming part of the paper machine and the blade guide forming part of the blade-changing apparatus.

6. The apparatus according to claim 1 in connection with a single worn doctor blade removed from its operating location, characterized in that the apparatus includes transfer members for moving the doctor blade through the measuring members while the apparatus remains stationary.

7. The apparatus according to claim 6, characterized in that at least one measuring member is arranged to be a transfer member.

8. The apparatus according to claim 1, characterized in that the apparatus includes contactless detector members for measuring one dimension of the doctor blade and/or for detecting an identifier attached to the doctor blade.

* * * * *